United States Patent [19]

Oguro et al.

[11] Patent Number: 4,733,124

[45] Date of Patent: Mar. 22, 1988

[54] CATHODE STRUCTURE FOR MAGNETRON

[75] Inventors: Tomokatsu Oguro; Hidetsuyo Baba, both of Mobara, Japan

[73] Assignee: Hitachi, Ltd., Tokyo, Japan

[21] Appl. No.: 807,371

[22] Filed: Dec. 10, 1985

[30] Foreign Application Priority Data

Dec. 12, 1984 [JP] Japan ..... 59-260706

[51] Int. Cl.[4] ..... H01J 25/50

[52] U.S. Cl. ..... 313/341; 313/344; 313/558; 313/559; 313/560; 313/561; 315/39.51; 315/39.69; 315/39.57; 315/39.67

[58] Field of Search ..... 313/341, 344, 558, 559, 313/560, 561, 39.51, 39.69, 39.67, 39.57

[56] References Cited

U.S. PATENT DOCUMENTS

| | | | |
|---|---|---|---|
| 2,001,548 | 5/1935 | Romhild | 313/341 |
| 3,988,636 | 10/1976 | Sato et al. | 315/39.51 |
| 4,132,921 | 1/1979 | Hatayama et al. | 315/39.51 |
| 4,233,540 | 11/1980 | Tashiro et al. | 313/344 |

FOREIGN PATENT DOCUMENTS

| | | | |
|---|---|---|---|
| 5736752 | 8/1980 | Japan | 315/39.51 |
| 59-186224 | 10/1984 | Japan | 313/344 |

*Primary Examiner*—David K. Moore
*Assistant Examiner*—Michael J. Nickerson
*Attorney, Agent, or Firm*—Charles E. Pfund

[57] ABSTRACT

A cathode structure for a magnetron representative of a self-oscillation type microwave electron tube comprises a pair of opposite end shields for supporting both ends of a filament helically wound in an axial direction, and a getter fixed on at least an upper end shield positioned on the side of a terminal from which a microwave oscillation output is produced. The upper end shield is concaved with respect to a lower end shield, and the getter provided on the upper end shield is also concaved so as to be closely fitted over substantially the entirety of an outer surface of the upper end shield. Preferably, the getter provided on the upper end shield has an upright annular wall of a central burring hole. Thus, the improved cathode structure is immune to deformation and suitable for cleaning and welding, thereby ensuring improved lifetime stability and high fabrication efficiency.

12 Claims, 4 Drawing Figures

CATHODE STRUCTURE FOR MAGNETRON

BACKGROUND OF THE INVENTION

The present invention relates to a cathode structure for a magnetron, and more particularly to an improvement in the structure of an upper end shield for supporting the upper end of a filament and in the structure of a getter fixedly arranged on the upper end shield.

As typical self-oscillation type microwave electron tubes, magnetrons have been widely used. As is well known, a magnetron comprises an anode of a divided cavity structure and a cathode surrounded by the anode. With this magnetron, based on the interaction between electrons emitted from the cathode and a high frequency electric field, high frequency power is produced as a microwave oscillation output.

FIG. 1 is a longitudinal sectional view schematically illustrating an example of a conventional cathode structure for a magnetron as disclosed in Japanese Patent Unexamined Publication No. 57-36752. The cathode structure for a magnetron shown comprises a helical filament 1 for emitting thermal electrons, an upper end shield 2 for holding the upper end of the filament 1, a lower end shield 3 for supporting the lower end of the filament 1 and provided with a hole 3*a* in the center thereof, a center support 4 disposed within the hole 3*a* of the lower end shield 3, the center support 4 supporting, at one end, the upper end shield 2 and serving as a lead conductor through which a predetermined amount of power is supplied, a side support 5 supporting, at one end, the lower end shield 3 and also serving as a lead conductor for supplying the predetermined amount of power, and getters 6 fixed on the upper and lower end shields 2 and 3 by welding, respectively. The other end of each of the center and side supports are connected to a power supply not shown.

In the cathode structure for the magnetron thus configured, the filament 1 wound around the center support is ordinarily formed of a thorium-tungsten wire, the getter 6 is formed of metal such as zirconium or titanium, and the upper and lower end shields 2 and 3, the center support 4 and the side support 5 are formed of metal having a high melting point such as molybdenum or tungsten. In this structure, there are junctions between both ends of the filament 1 and the upper and lower end shields 2 and 3, a junction between the upper end shield 2 and the center support 4, and a junction between the lower end shield 3 and the side support 5. A bonding operation is applied to these junctions by using eutectic alloy brazing materials 7 of ruthenium and molybdenum to electrically an mechanically join together respective member.

However, it has been experimentally confirmed that the thus configured conventional cathode structure for the magnetron includes various kinds of problems described below:

(1) Since the getter 6 is formed as an approximately 0.05 mm thick, disk-shaped thin plate having a small aperture in the central portion thereof, it is likely to be deformed and warped owing to cleaning, heat treatment, or handling after press forming work.

(2) When joining together the upper end shield 2 and the getter 6 by spot-welding, a large warping of the getter 6 as previously mentioned tends to cause a welded portion to break and float, and the warping of the getter 6 makes it difficult to carry out welding work.

(3) In operations of the magnetron, heat transfer from the upper end shield 2 to the getter 6 through welded portions differs from that through not-welded floating portions. Thus, this leads to non-uniformity in temperature of the getter 6, with the result that gas absorption effect of the getter 6 becomes non-uniform and a speed at which the getter 6 reacts with gas molecules is lowered. Further, there exists non-uniform inter-diffusion at contact portions between the upper end shield 2 and the getter 6, causing the getter 6 to be deformed remarkably and to be partially stripped off from the upper end shield 2.

(4) The getter material is oiled during press forming and oil remains deposited on the surface of the getter. When cleaning the getter 6 for removal of oil therefrom after pressing work forming, getters 6 stacked one after another tend to adhere closely to each other through oil, with the result that removal of oil by cleaning becomes insufficient. Further, the close adherence of the getters is aggravated during the subsequent heat treatment, thus making it extremely difficult to separate and supply getters 6 for the welding work. In such a case, if an attempt is made to forcedly supply getters 6, they will be greatly deformed.

Because of the drawbacks with the conventional cathode structure as described above, the lifetime of the conventional magnetron is greatly shortened and the fabrication working efficiency thereof is low.

SUMMARY OF THE INVENTION

Accordingly, an object of the present invention is to provide a cathode structure for a magnetron capable of preventing the getter from being deformed to thereby ensure stable lifetime and high fabrication efficiency.

To achieve the above object, the present invention provides a cathode structure for a magnetron producing microwave oscillation energy from an output terminal, the cathode structure comprising a pair of opposite end shields for supporting both ends of a filament helically wound in an axial direction, and a getter fixed on at least one of the opposite end shields, the one end shield being positioned on the side of the output terminal, characterized in that the one end shield is concaved with respect to the other end shield opposite thereto, and the getter is also concaved so as to be substantially commensurate with an outer surface of the one end shield and closely fitted over substantially the entirety of the outer surface.

In general, the cathode structure for magnetron faces a problem that both the getters provided on the upper end shield and the lower end shield tend to be deformed. Structurally, the getter provided on the lower end shield will not undergo relatively high temperatures. Accordingly, there is little possibility that the getter provided on the lower end shield is so deformed during use that it is stripped off. Conversely, the getter provided on the upper end shield will be subject to relatively high temperatures and deformed considerably. In view of this, the present invention has improved the upper end shield and the getter provided thereon in their shape, thus making it possible to realize a cathode structure for a magnetron having high lifetime stability and high fabrication efficiency.

BRIEF DESCRIPTION OF THE DRAWING

The features and advantages of a cathode structure for a magnetron according to the present invention will become more apparent from the following description taken in conjunction with the accompanying drawing, in which.

DESCRIPTION OF THE PREFERRED EMBODIMENTS

Figure 1:
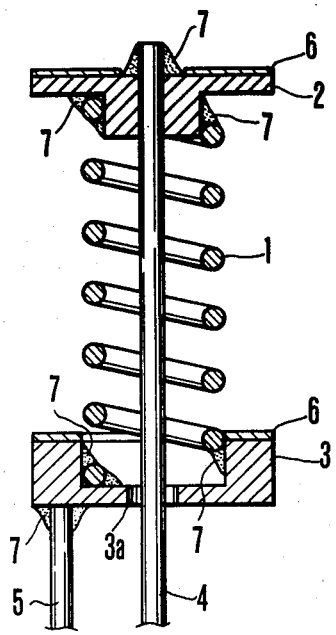
FIG.1 PRIOR ART
FIG. 1 is a longitudinal sectional view illustrating a conventional cathode structure for a magnetron.
Figure 2:
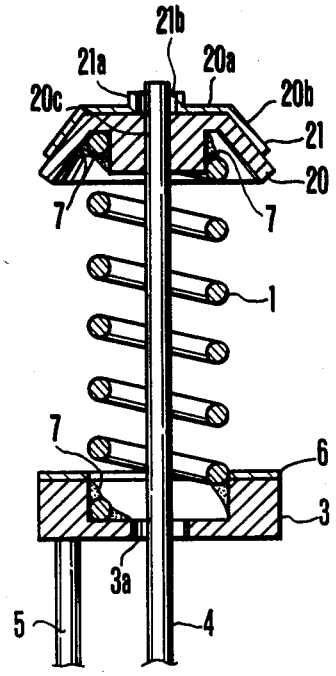
FIG. 2 is a longitudinal sectional view illustrating an embodiment of a cathode structure for a magnetron according to the present invention.

Referring to FIG. 2, there is shown one form of a cathode structure for a magnetron according to the present invention wherein parts identical to those in FIG. 1 are designated by the same reference numerals.

An upper end shield 20 is formed of metal having a high melting point such as molybdenum or tungsten etc. The upper end shield 20 is formed concavely with respect to the lower end shield 3. In this embodiment, there is employed the upper end shield 20 which looks like umbrella in appearance, and the upper end shield 20 has a frusto-conical contour. Accordingly, when sectioned, it has a central flat portion 20*a* and inclined flange portions 20*b* contiguous thereto. The upper shield 20 has a center hole 20*c*. To the upper surface of the upper end shield 20 thus formed, a getter 21 is fixed by welding. The getter 21 is also formed concavely. More particularly, the getter 21 is substantially commensurate with an outer surface of the upper end shield 20 and is closely fitted over substantially the entirety of the outer surface. In addition, the getter 21 is provided in the central portion thereof with an upright annular wall 21*a* of central burring hole 21*b* through which the upper end of the center support 4 passes. The getter 21 is fixed to the upper end shield by spot welding, for example.

The getter 21 of this embodiment is generally of a three-dimensional structure and as well known in the art, it is highly resistant to external force and internal stress and therefore more robust than the conventional two-dimensional flat getter 6. Especially, the upright wall 21*a* is effective to further promote robustness.

The employment of such a three-dimensional structure can enhance the overall strength of the getter 21 as explained above and besides increase effective surface area of the getter 21, thus providing improved getter effect. Moreover, the getter 21 has the upright annular wall of burring hole which acts as a distance piece and hence getters can be stacked without being brought into close contact with each other at the time of cleaning in the fabrication process of the getter 21, thus improving cleaning effect (especially, removal of oil) and ensuring uniform cleaning. The highly cleaned and mechanically strong getters in stack are thereafter subjected to heat treatment during which they will not be deformed thanks to their robustness and will be held distantly from each other, thus extremely facilitating separation and supply of getters 21 for welding work conducted subsequently. Eventually, the cathode structure thus configured makes it possible to suppress floating of the getter 21 from the upper end shield 20, thus extremely reducing occurrence of faults due to deformation of the getter 21 when the magnetron is used.

Figure 3:
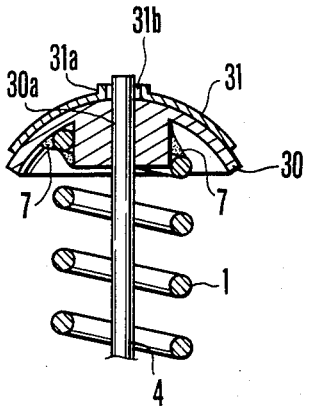
FIG. 3 is a similar view of another embodiment of the invention.
Figure 4:
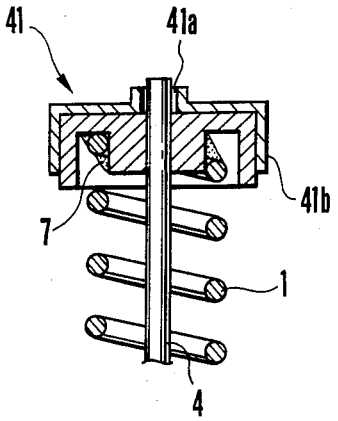
FIG. 4 is a sectional view showing a getter member conceivable but unsuitable for the present invention.

FIG. 3 shows an essential part of a modified embodiment. In this modification, the three-dimensional structure is materialized by an upper end shield 30 having a semi-spherical contour and a getter 31 formed semi-spherically. Like the previous embodiment, the getter 31 has an upright annular wall 31*a* of central burring hole 31*b*, and a hole 30*a* is formed in the end shield 30. As a three-dimensional getter, a getter member 41 as shwon in FIG. 4 may be conceivable having a peripheral portion 41*b* which is bent at right angles with respect to a flat portion 41*a*. This structure is, however, unsuitable for the getter from the standpoint of easiness of press forming, getter effect and easiness of handling when stacking.

The getter members of FIGS. 2 and 3 can readily be prepared by pressing a sheet of getter material.

As stated above, in accordance with the cathode structure for magnetron according to the present invention, the getter to be provided on the upper end shield is concaved so as to be substantially commensurate with an external form of the upper end shield. This form of getter is immune to deformation and suitable for cleaning and welding, thus contributing to realization of an improved magnetron having high lifetime stability and high fabrication efficiency.

What is claimed is:

1. A cathode structure for a magnetron producing microwave oscillation energy from an output terminal, said cathode structure comprising a pair of opopsite end shields for supporting both ends of a filament helically wound in an axial direction, and a getter fixed on one of said opposite end shields positioned on the side of said output terminal, the improvement wherein (a) said one of said opposite end shields is formed with convex outer surface with respect to the other one of said opposite end shields, and (b) said getter is a thin disc formed concavely so as to be in substantially contiguous contact with said outer surface, extends closely fitted over substantially the entirety of said outer surface, and is provided in its central portion with an upright annular wall of a central burring hole which extends from the convex outer surface of said disc.

2. A cathode structure for a magnetron as set forth in claim 1, wherein said one of said opposite end shields has a frusto-conical contour.

3. A cathode structure for a magnetron as set forth in claim 1, wherein said one of said opposite end shields has a semi-spherical contour.

4. A cathode structure for a magnetron as set forth in claim 1, which further comprises a getter provided on an inner surface of the other one of said opposite end shields.

5. A cathode structure for a magnetron as set forth in claim 1, which further comprises a center support having one end passing through said burring hole and a center hole formed in said opposite end shields and having its other end passing through a center hole of the other one of said opposite end shields, said filament being wound around said enter support, said center support thereby functioning as a lead conductor for supplying power to said filament.

6. A cathode structure for a magnetron as set forth in claim 5, which further comprises a side support for supporting said other one of said opposite end shields and functioning as a lead conductor for supplying power to said filament.

7. A cathode structure for a magnetron as set forth in claim 1, wherein each of said pair of opposite end shields is formed of metal having a high melting point such as molybdenum or tungsten.

8. A cathode structure for a magnetron as set forth in claim 5, wherein said center support is formed of metal such as molybdenum of tungsten.

9. A cathode structure for a magnetron as set forth in claim 6, wherein said side support is formed of metal such as molybdenum or tungsten.

10. A cathode structure for a magnetron as set forth in claim 1, wherein said getter provided on said one of said opposite end shields is formed of metal such as zirconium or titanium.

11. A cathode structure for a magnetron as set forth in claim 4, wherein said getter provided on said other one of said opposite end shields is formed of metal such as zirconium or titanium.

12. A cathode structure for a magnetron as set forth in claim 1, wherein said filament is a thorium-tungsten wire.

* * * * *